United States Patent [19]

Danin

[11] 4,277,856

[45] Jul. 14, 1981

[54] ARTICLE OF FURNITURE

[76] Inventor: Colin Danin, 14 Homestead Rd., Bedfordview, Transvaal, South Africa

[21] Appl. No.: 46,790

[22] Filed: Jun. 8, 1979

[30] Foreign Application Priority Data

Jan. 10, 1979 [ZA] South Africa ..... 79/0102

[51] Int. Cl.[3] ..... A47C 17/60; A47C 17/62

[52] U.S. Cl. ..... 5/3; 297/157

[58] Field of Search ..... 5/3, 4, 5, 6, 159 R; 297/159, 157

[56] References Cited

U.S. PATENT DOCUMENTS

| | | | |
|---|---|---|---|
| 201,795 | 3/1878 | Kiss | 5/4 |
| 804,658 | 11/1905 | Hastings | 297/157 |
| 1,868,642 | 7/1932 | Schlesinger | 5/4 |
| 3,161,892 | 12/1964 | Ducrot | 5/5 |
| 3,256,037 | 6/1966 | Giambalvo | 297/159 |
| 3,638,249 | 2/1972 | Katsigarakis | 5/6 |

FOREIGN PATENT DOCUMENTS

| | | | |
|---|---|---|---|
| 1159439 | 6/1958 | France | 5/3 |
| 1420298 | 10/1965 | France | 5/3 |

*Primary Examiner*—Alexander Grosz

*Attorney, Agent, or Firm*—Haseltine and Lake

[57] ABSTRACT

An article of furniture which comprises first and second support members and at least one planar member supported by at least one of the support members, the support members being movable between first positions at which the planar member is substantially horizontal thereby forming a working top, and second positions at which the support members provide at least part of a sleeping surface.

4 Claims, 5 Drawing Figures

ARTICLE OF FURNITURE

BACKGROUND OF THE INVENTION

This invention relates to an article of furniture.

Many families suffer from an acute shortage of living space. Large families particularly, because of high housing costs, are normally of necessity forced to utilise all available space in a dwelling. It may thus happen that certain areas of a dwelling which during the day are used as cooking or eating areas are at night used as sleeping areas.

Beds are particularly space consuming and attempts have been made in the past to provide beds which can be folded up, when not in use, into less bulky objects. Thus it is known to fold a bed frame about a centre line, in jack-knife fashion, for storage purposes. It is also known to make a bed frame with a central portion, which is supported by two pairs of legs, and two wing portions, each of which is hinged to the central portion and with legs at its free end. This construction permits the mattress to be folded up together with the bed frame, but because the resulting folded bed is supported in the folded condition by the legs of the central portion it has a height which is greater than half the length of the bed and so is particularly unattractive, the more so because the underside of the bed is exposed to view.

SUMMARY OF THE INVENTION

It is an object of the present invention to provide an article of furniture which alleviates these problems.

The invention provides an article of furniture which comprises first and second members and at least one planar member supported by at least one of support members, the support members being movable between first positions at which the planar member is substantially horizontal thereby forming a working top, and second positions at which the support members provide at least part of a sleeping surface.

In one form of the invention the article includes one planar member secured to one of the support members and supported by both support members at the first positions, the planar member being substantially vertically disposed with the support members at the second positions and forming a headboard for the sleeping surface.

In a second form of the invention the article includes two planar members each of which is secured to one of the support members.

Further according to the invention the article includes a connecting piece, the support members being pivotally connected to the connecting piece at what is their lower ends when at the first positions, the connecting piece being raised when the support members are moved to the second positions.

Further according to the invention the connecting piece is raised so that it is flush with the support members and also forms part of the sleeping surface, when the support members are moved to the second positions.

Further according to the invention the support members at the first position form at least part of an enclosure for mattress means, such as foam cushions, which are used on the sleeping surface.

Further according to the invention the article includes first and second seating means which are located on opposed sides of the support members, and which are pivotally connected to the support means.

BRIEF DESCRIPTION OF THE DRAWINGS

The invention is further described by way of examples with reference to the accompanying drawings in which.

DESCRIPTION OF PREFERRED EMBODIMENTS

Figure 1:
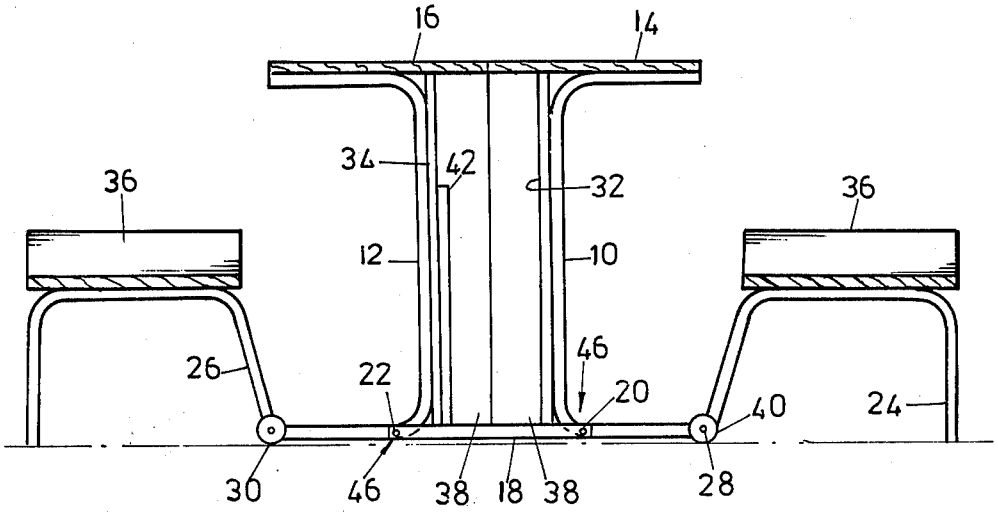
FIG. 1 is a side view of an article of furniture according to the invention arranged to form a table and seats.
Figure 2:
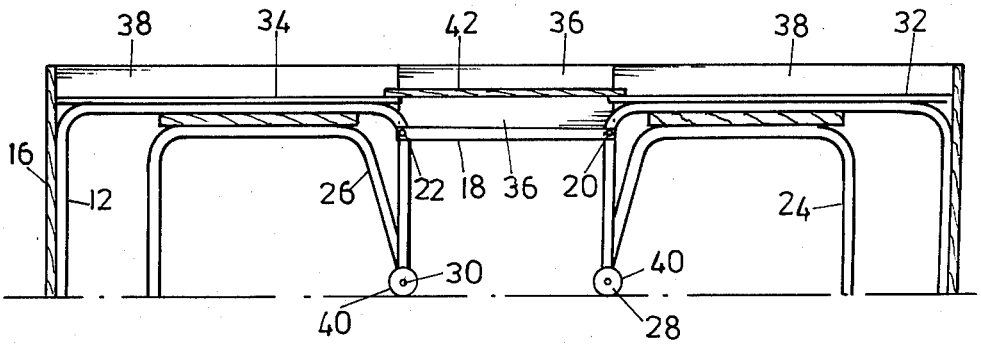
FIG. 2 is a side view of the article of FIG. 1 arranged to form a bed.

FIGS. 1 and 2 illustrate an article of furniture according to a first form of the invention. The article consists of two C-support frames 10 and 12 respectively, two rectangular pieces of sheet material 14 and 16 secured to one limb of the support frames 10 and 12 respectively, a connecting piece 18 pivotally connected to the support frames 10 and 12 at points 20 and 22 respectively, and two benches 24 and 26 pivotally connected to the support frames 10 and 12 at points 28 and 30 respectively.

Suitable sheets 32 and 34 of a strong material such as particle board are secured to the support frames 10 and 12 respectively.

The benches 24 and 26 are substantially equal in length to the width of the sheets 14 and 16. The benches as shown in FIG. 1 normally support foam cushions 36. Similarly with the article of furniture in the position shown in FIG. 1 the sheets 32 and 34 form part of an enclosure which accommodates foam cushions 38.

The article as shown in FIG. 1 forms a table with the benches 24 and 26 on either side of the table. The benches are fixed by their pivotal connection to the support frames and therefore cannot be moved closer to or away from the table. The article is converted from a table into a bed by removing the foam cushions 36 from the two benches and then pivoting the support frames 10 and 12 outwardly away from each other so that they settle over the benches. The dimensions of the benches and of the support frames are so chosen that when the sheets 32 and 34 are substantially horizontal the benches nestle underneath the support frames and the sheets 32 and 34 and the ends of the C-frames rest on the floor. The pivotal movement of the frames is greatly assisted by the provision of rollers or wheels 40 at the pivot points 28 and 30. With the table opened up as shown in FIG. 2 the cushions 38 are substantially horizontal and are supported by the sheets 32 and 34. The foam cushions 36 removed from the benches are then placed one on top of each other on the connecting piece 18 to complete the sleeping surface of the bed. As the frames are pivoted in this way the connecting piece 18 is raised from a position close to floor level to a level at which it is nearly flush with the sheets 32 and 34.

As an alternative to the placing of the cushions 36 on the connecting piece 18 use could be made of a bridging piece 42 which is accommodated between one of the sheets 34 and cushions 38 when the article is in the form of a table and which is moved to bridge the gap between the two sheets 32 and 34 when the article of furniture is converted into a bed. In this case only one of the cushions 36 is placed on top of the bridging piece.

Figure 3:
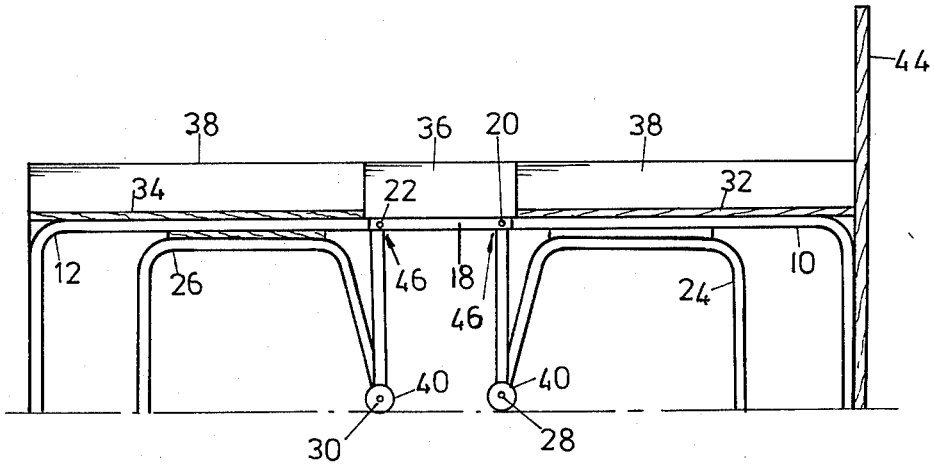
FIG. 3 is a similar view to FIG. 2 but of an article according to a different form of the invention.

FIG. 3 illustrates a different form of the invention. In this case the article of furniture differs in two important respects from the article shown in FIGS. 1 and 2. Firstly the table top is formed from a single sheet 44 of material which is secured only to the support frame 10. When the article is folded into a table the sheet 44 is supported by both of the frames. When the article is converted into a bed the sheet 44 forms a headboard for the bed.

A second point of difference is that the C-frames 10 and 12 are not curved at the lower ends 46 but are formed with distinct right angles. The pivot points 20 and 22 are therefore located closer to each other in the article of FIG. 3 than in the article of FIGS. 1 and 2. This has the advantage that when the article is converted into a bed the connecting piece 18 is substantially in the same plane as the sheets 32 and 34 and the use of two cushions 36, or of the bridging piece 42, can be dispensed with.

Figure 4:
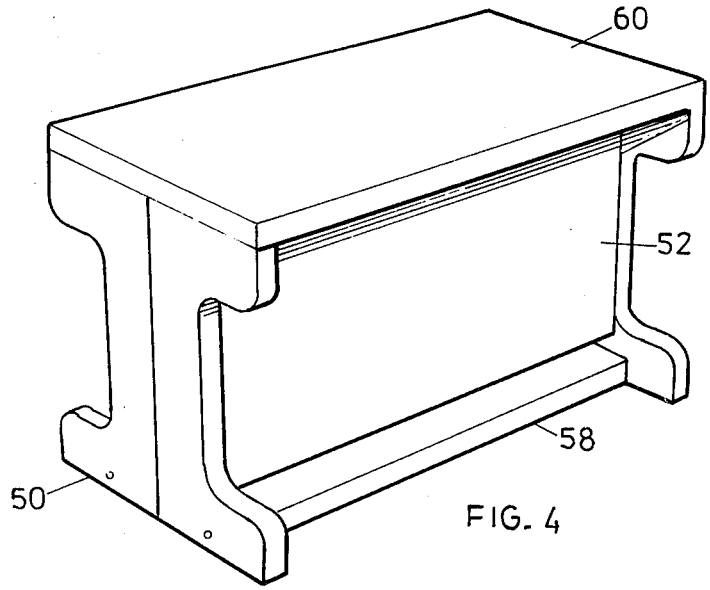
FIGS. 4 and 5 are perspective views of an article of furniture according to a third form of the invention arranged to form a table, and a bed, respectively.
Figure 5:
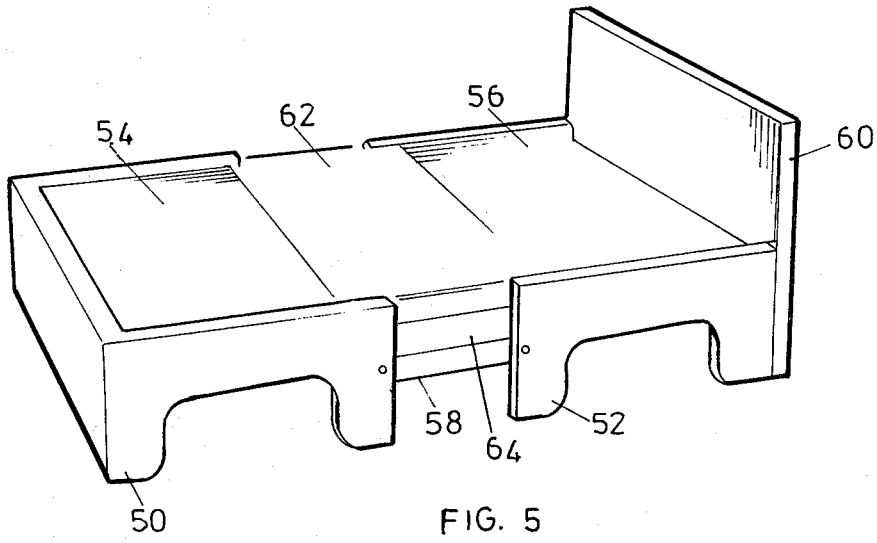

FIGS. 4 and 5 illustrate a third form of the invention which lends itself to production from wood or moulded products such as polyurethane or other plastics materials. The article consists of two recessed C-type frames 50 and 52 which hold foam cushions 54 and 56 respectively. The frames are pivotally connected at their lower ends (see FIG. 4) to a connecting piece 58. A headboard 60 is secured to the frame 52.

The arrangement is such that when the bed is folded into the table, as shown in FIG. 4, the connecting piece 58 is lowered practically to ground level and the working surface formed by the headboard 60 is at a convenient, and conventional, level. The table may be fitted with chairs, or simply be used as a desk.

On the other hand when the table is opened to form a bed, as shown in FIG. 5, the connecting piece 58 is raised. Two small cushions 62 and 64 may then be placed on the connecting piece to form, together with the cushions 54 and 56, a planar sleeping surface.

I claim:

1. An article of furniture which comprises:

first and second support members each of which has a cushion supporting section;

at least one planar member supported by at least one of the support members;

the support members being movable between first positions at which the cushion supporting sections are substantially vertical and are spaced from and oppose one another and at which the planar member is substantially horizontal to form a working top, and second positions at which the cushion supporting sections are substantially horizontal and provide at least part of the sleeping surface; at least one connecting piece adapted to pivotally interconnect the support members at what are their lower ends when at the first positions, each support member having at least one leg which is substantially horizontal and rests on the ground to stabilize the article of furniture when the support members are in the first positions; the support members being pivotal about the free ends of the legs while being moved to the second positions, whereby the legs are pivoted to upright positions and the connecting piece is raised to a position at which it also forms part of the sleeping surface, the legs in the vertical positions supporting the cushion supporting sections horizontally.

2. An article of furniture according to claim 1, wherein: the connecting piece has a length which is greater than the spacing between the vertical cushion supporting sections and is pivotally connected to the support members at points which are spaced apart by a distance which is greater than the spacing between the vertical cushion supporting sections.

3. An article of furniture according to claim 1, wherein: each support member includes a portion which opposes the leg and is substantially horizontal to support the planar member when the support members are in the first positions, the portions being moved to upright positions at which they support the cushion supporting sections horizontally when the support members are moved to the second positions.

4. An article of furniture according to claim 3 wherein: at least one seating means being pivotally connected to the free end of the leg of one support member, the seating member being located below the cushion supporting section of the support member when the support member is in the second position.

* * * * *